United States Patent [19]

Nix

[11] 4,324,090

[45] Apr. 13, 1982

[54] SADDLE

[76] Inventor: Richard J. Nix, P.O. Box 316, Quakertown, N.J. 08868

[21] Appl. No.: 97,332

[22] Filed: Nov. 26, 1979

[51] Int. Cl.[3] ..... B68C 1/02

[52] U.S. Cl. ..... 54/44; 54/46

[58] Field of Search ..... 54/23, 37, 38, 42, 44, 54/46, 66

[56] References Cited

U.S. PATENT DOCUMENTS

| | | | |
|---|---|---|---|
| 1,531,672 | 3/1925 | McLean | 54/46 X |
| 2,153,326 | 4/1939 | Crouter | 54/46 X |
| 2,730,853 | 1/1956 | Manning | 54/46 |
| 3,153,887 | 10/1964 | Bohlin | 54/37 |
| 3,293,828 | 12/1966 | Hessler | 54/44 |
| 3,835,621 | 9/1974 | Gorenschek | 54/44 |
| 3,911,648 | 10/1975 | Lightfoot | 54/44 |
| 3,978,644 | 9/1976 | Hillman | 54/44 |

*Primary Examiner*—Robert Peshock
*Assistant Examiner*—Robert P. Swiatek
*Attorney, Agent, or Firm*—Horst M. Kasper

[57] ABSTRACT

A horsesaddle is described providing close contact between horse and rider. The saddle comprises a saddle tree having two narrow side bars of about oval cross-section having a major axis of from about 4.2 cm to 5.8 cm length and a minor axis of from about 0.5 cm to 0.8 cm length. Padding is provided corresponding to the area of the two side bars and the padding is located below the tree. The skirt of the saddle is cut out around the position of the rider's legs and the cut out areas are inserted with bulging soft leather. A dual position billet strap is attached to a piece of webbing attached with screws to the tree. A girth with elastically mounted buckles engages the billet.

7 Claims, 14 Drawing Figures

20
22, 24
26
28
40
42
44
60
90
110
130
132
133
5
7
7'
8
61
62
64
66
80
82
d
e
f
g
h

FIG. 9
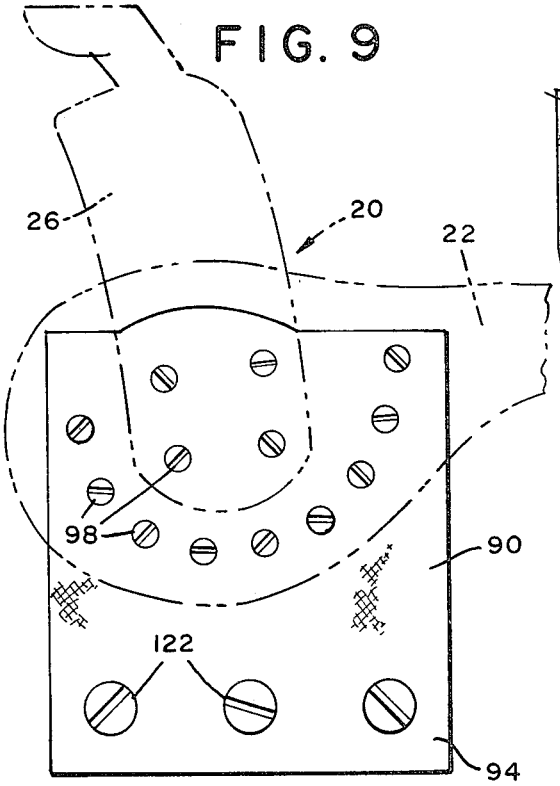
FIG. 11
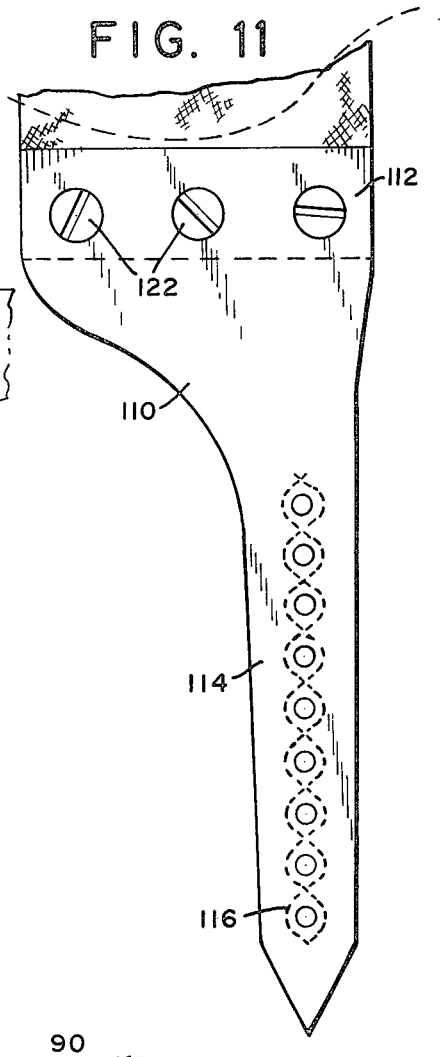
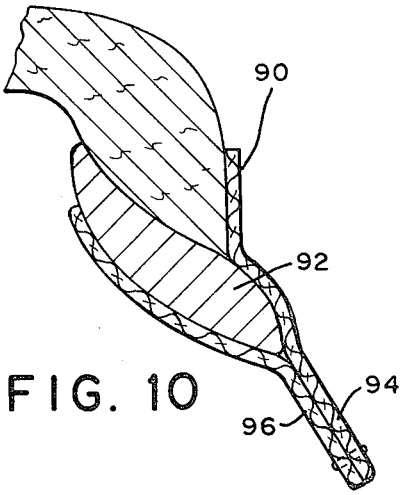
FIG. 10
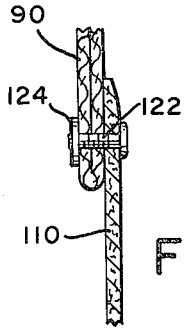
FIG. 12

SADDLE

BACKGROUND OF THE INVENTION

1. Field of the Invention

This invention relates to a horse saddle comfortable to both rider and horse and providing for good contact between rider and horse.

2. Description of the Prior Art

Saddles in the past have been quite rigid and tended to be uncomfortable during longer use. They were relatively heavy and limited the contact between rider and horse resulting in occasional loss of control of the rider over the horse. Partial solutions to these and other problems have been provided in the past. M. Gorenscheck in U.S. Pat. No. 3,835,621 issued Sept. 17, 1974 discloses a flexible saddle tree having resilient sheepskin padding on the underside for providing a conforming fit to the shape of the horse. Elastic sheeting is attached to the underside of the side-bars and stuffed with horse hair and covered with sheepskin.

J. G. Hillman in U.S. Pat. No. 3,978,644 issued Sept. 7, 1976 discloses a saddle tree based on a stainless steel rod frame bent in a general U-shape with an upstanding fork bight. As shown in FIG. 1 of this reference, although the steel bars are relatively narrow and thin, only a small vent is provided in the tree of the saddle shown.

R. O. Lightfoot in U.S. Pat. No. 3,911,648 issued Oct. 14, 1975 discloses a saddle tree formed partly of rigid material and partly of resiliently compressible material. A. Hessler in U.S. Pat. No. 3,293,828 issued Apr. 21, 1965 describes a saddle tree construction employing glass reinforced materials and providing a small gullet.

These references do not provide a relatively light saddle providing maximum comfort and safety to both rider and horse.

SUMMARY OF THE INVENTION

1. Purposes of the Invention

It is an object of the present invention to provide a saddle comfortable to both horse and rider.

It is a further object of the invention to provide a relatively light saddle ensuring good contact between horse and rider and giving excellent control to the rider.

It is another object of the present invention to provide a saddle which is resiliently fastened to the horse with a girth, but which allows the horse to breathe easily.

These and other objects and advantages of the present invention will become evident from the description which follows.

2. Brief Description of the Invention

The present invention provides a horse saddle allowing close contact between rider and horse. A tree is employed in its construction having a fork located toward the front of the horse, a cantle located toward the rear of the horse, two narrow side bars of oval cross-section having a major axis of from about 4.2 to 5.8 cm length and a minor axis of from about 0.5 cm to 0.8 cm length through the area of the leg line and starting with such cross-section about at most 8 cm from the back side of the fork and reaching with such cross-section to at most about 4 cm away from the cantle and said side bars are connecting the fork with the cantle. A skirt is attached to the bottom of the saddle tree. Preferably, padding areas are provided corresponding to the two bars of the tree and located below the skirt and having relatively narrow sections following the configuration of the tree bars and ending in front and rear lobes, said front lobes extending in an outward direction about vertical to the longitudinal direction of the tree bars at about the fork and said rear lobes extending in about rear direction about parallel to the direction of the side bars at about below the cantle. The skirt is preferably cut out in an area bordered by part of the circumference of the skirt and by three sides with a first side located about 1 to 5 cm away from the outside vertical projection of the edge of the side bars and extending about parallel to the tree side bars from about the middle of the fork and running to about the end of the narrow section of the side bar, a second section beginning at the end of the first side near the middle of the fork and running outwardly in a direction between about vertical to the first side and to forming an angle of about 30° with the front direction of the side bars, a third side beginning at the other end of the first side at the rear end of the side bars and running outwardly in a direction between about vertical to the first side and a direction forming an angle of about 45° with the front direction of the tree side bars. The three sides together with part of the circumference of the skirt from a trapezoidal to oval area. The section cut out is inserted with a material thinner and more deformable than the skirt material. Preferably, the inserted material bulges out of the cut out area of the skirt. The skirt is covered with soft leather.

Preferably a strong webbing is provided on each side of the saddle from about 10 to 20 cm wide and attached to the top and the bottom side of the tree in the area of the fork and running to from about 3 cm to 15 cm outwardly from the outer side edges of the tree.

In one aspect of the invention a billet is provided having a wider section of about the width of the webbing removably attached to the webbing and going over into a narrower section displaced from the middle of the wider section to one side for providing a dual positioning of the billet by reattaching it from one side of the saddle to the opposite side. A girth can be provided to be attached to the billet having a width of from about 10 cm to 20 cm at the heart of the girth and from about 7 to 12 cm at the ends and fitting around the legs of the horse and comprising a roller buckle attached with elastic bands to the girth and capable of sliding longitudinally to the girth upon tensioning of the girth.

BRIEF DESCRIPTION OF THE DRAWINGS

In the accompanying drawings in which is shown one of the various possible embodiments of the invention:

FIG. 9 is a side elevational view of the webbing;

FIG. 10 is a view of a cross-section through the webbing;

FIG. 11 is a view of the billet;

FIG. 12 is a sectional view showing the attachment of the billet to the webbing;

DETAILED DESCRIPTION OF THE PREFERRED EMBODIMENTS

According to the present invention a horse saddle is provided which is comfortable to both horse and rider and which ensures for the rider good contact with and good control over the horse.

Figures 1, 2, 3, 4, 5, 6, 7, 8:
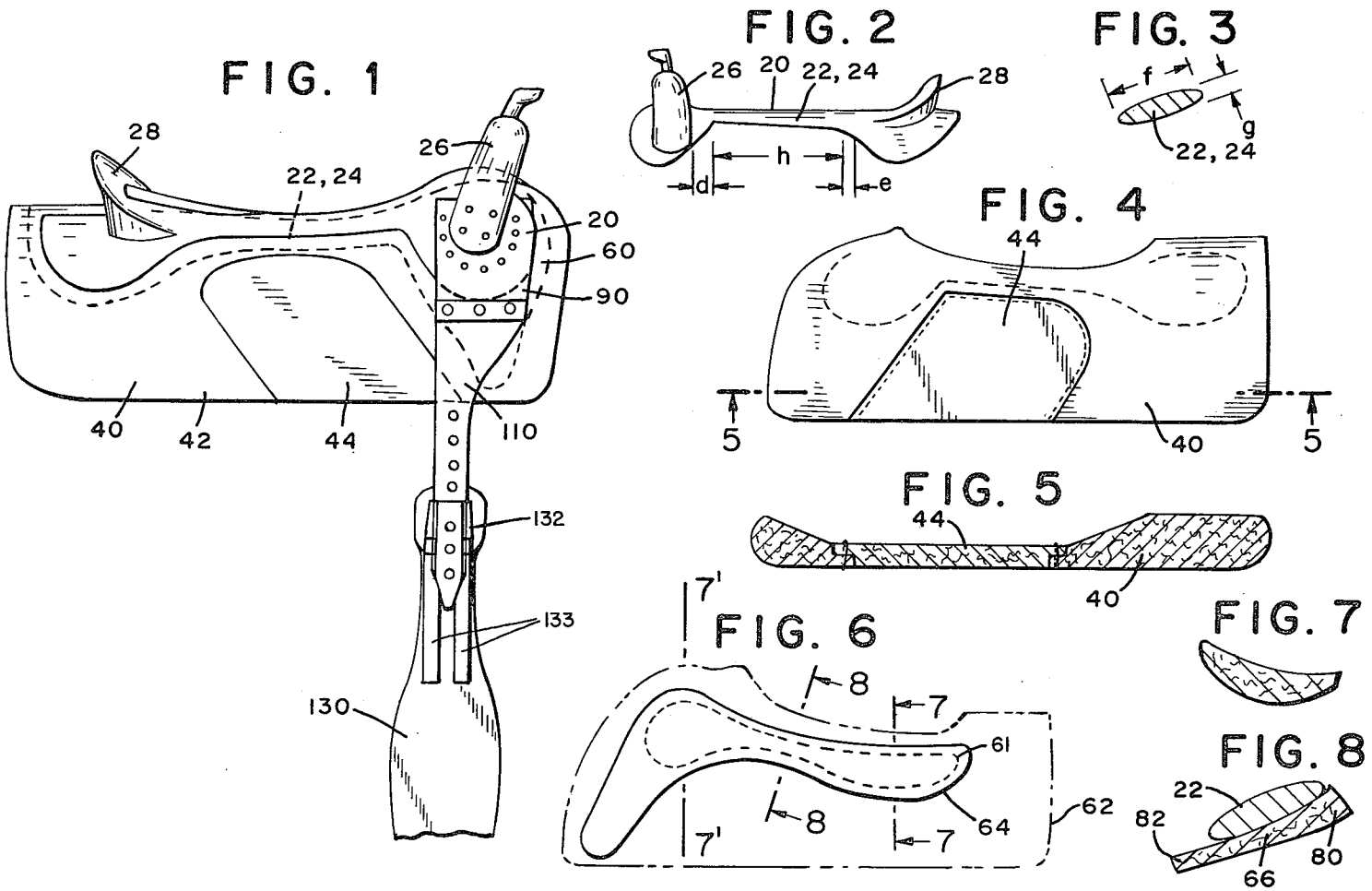
FIG. 1 is a schematic view of the parts forming the saddle.
FIG. 2 is a view showing a side elevation of the saddletree.
FIG. 3 is a cross-sectional view of a side bar of FIG. 2.
FIG. 4 is a side elevational view of the skirting of the saddle.
FIG. 5 is a sectional view taken substantially along the line 5—5 of FIG. 4 and showing a cross-section of the skirt in the area of the cut out and inserted piece.
FIG. 6 is a side elevational view of the saddle padding.
FIG. 7 is a sectional view taken substantially along the line 7—7 or 7′—7′ of FIG. 6 and showing a cross-section of the padding in the middle of the saddle.
FIG. 8 is a sectional view taken substantially along the line 8—8 of FIG. 6 and showing a cross-section of the padding near the end of the saddle.

Referring now to FIG. 1 there is shown a schematic view of the relative arrangement of the parts of the saddle of the present invention. A saddle tree 20 forms the basis. The tree comprises the tree side bars 22, 24, the fork 26 and the cantle 28. The tree 20 is covered with a skirt 40 having a heavy and thick section 42 and an elastic light and thinner section 44. Below the tree 20 and the skirt 40 there is located padding material 60. In the area below the fork 26 there is attached to the upper side and the lower side of the tree on both sides of the tree a piece of folded webbing 90. The webbing 90 supports dual position billet straps 110. The billet straps 110 engage a girth 130 attached with two elastic bands 133 to a buckle 132 for securing the saddle to the horse.

FIG. 2 shows a schematic side elevation view of the saddletree 20. The tree comprises the tree bars 22, 24, the fork 26 and the cantle 28. A critical feature of the saddletree of the present invention are the shape and dimensions of the side bars. The side bars are of an oval cross-section as shown in FIG. 3 in the area of the leg line starting about a distance "d" from the backside of the fork and extending up to a distance "e" away from the cantle. The distance d is at most about 8 cm and preferably from about 4 cm to 6 cm. The distance e is at most about 4 cm and preferably between 2 and 3 cm. The major axis of the oval cross-section of the side bars in the area of the leg line has a size "f" of from about 4.2 cm to 5.8 cm and preferably of from about 4.5 to 5.5 cm. The minor axis of the oval cross-section of the side bars in the area of the leg line has a size "g" of from about 0.5 to 0.8 cm and preferably of from about 0.6 cm to 0.7 cm. The length "h" of the narrow section of the side bars will change with the size of the saddle seat size.

The tree is preferably covered with raw hide which may be stressed on and stiched.

Referring now to FIG. 4 there is shown a side elevational view of the skirting. Conventionally the skirt is a single piece of heavy leather. The overall shape of the skirt of the present invention is that of a conventional skirt for a saddle. However, according to the present invention, part of the heavy skirting leather is cut out and replaced by an insert 44 of thinner and more elastic material having relatively high tensile strength.

The skirting leather is preferably a strong and heavy leather of a thickness of from about 0.4 to 0.6 cm and cowhide is a preferred material. As insert material there is preferably employed a very flexible soft but strong leather. It is desirable to have the insert surface slightly larger than the cut out area to provide for bulging of the insert. This allows the rider good contact with the horse giving excellent control and safety, since the cut out area corresponds substantially to the area where the leg of the rider is in contact with the horse. The area of the cut out is bordered by part of the circumference of the skirt and by three sides. The first side is located about 1 cm to 5 cm away from the outside vertical projection of the side bars and extending about parallel to the side bars from about the middle of the fork and running to about the end of the narrow section of the side bars, a second section beginning at the end of the first side near the middle of the fork and running outwardly in a direction between about vertical to the first side and to forming an angle of about 30° with the front direction of the side bars, and a third side beginning at the other end of the first side at the rear end of the side bar and running outwardly in a direction between about vertical to the first side and a direction forming an angle of about 45° with the front direction of the side bars. The cut out area resembles a trapezoidal to oval area. The material inserted in the cut out is in general thinner compared with the balance of the skirt. The insert material has to be elastic to deform around the leg of the rider. Bridle leather of a thickness of from about 0.2 to 0.3 cm is a preferred material.

In FIG. 5 is shown a sectional view of the skirt of FIG. 4 along section line 5—5. The thinner section of the insert is from 0.24 cm thick bridle leather and the heavy skirt part is from 0.47 cm thick skirting leather.

In FIG. 6 is shown a side elevational view of the padding provided according to the present invention and located under the tree of the saddle. The dashed inner line 61 of FIG. 6 indicates the contours of the saddle tree. The outer dashed line 62 in FIG. 6 indicates the circumference of the skirt. Line 64 indicates the outer reach of the padding below the tree. A major purpose of the padding is to provide comfort to the horse and to avoid the development of sore spots on the back of the horse. Furthermore the usual need for a pad under a saddle is eliminated when employing the padded saddle of the present invention.

The padding material is elastic and resilient. A preferred padding material is about 0.8 to 1.2 cm thick sheet felt. The underside of the padding is covered with about 0.5 to 0.7 cm thick soft felt which covers the padding and the skirt. Soft leather is then placed on and attached to the soft felt for finishing the underside of the saddle.

FIG. 7 shows a cross-sectional view along section line 7—7 or 7'—7' of FIG. 6. In this figure the shape of the padding in the front and rear area of the saddle is demonstrated. The padding is thicker in the middle (about 1.5 cm to 2 cm) and converges to the outer edges to a smaller thickness (about 0.5 to 1 cm). The cross-sectional view of the rear part and of the front part of the padding are similar and FIG. 7 provides a schematic view of either.

FIG. 8 shows the cross-section of the padding along section line 8—8 of FIG. 6. The padding 66 is next to the relatively thin oval section in the middle of the tree bars. The upper part of the padding is somewhat thicker than the lower part, but this depends on the contours of the side bars. Preferably, the thickness of the upper part of the padding at 80 is from about 1.3 to 1.8 cm and the thickness of the lower part at 82 is about 0.5 cm to 0.7 cm.

In FIG. 9 is shown the fork 26 of the tree 22 as a reference. A webbing 90 is attached to the front part of the tree in the fork area. A preferred way of attachment is to employ screws 98 to hold webbing and tree together. The webbing is about 12 to 18 cm wide and extends to about 4 cm to 8 cm below the lower part of the tree. The lower part 94 of the webbing is doubled with a second piece of webbing 96 which extends under the tree and which is attached to the tree as shown in FIG. 10. The lower parts of the webbing 94 and 96 are preferably stitched together to form a loop. The webbing is made from a strong material with relatively large tensile strength to prevent tearing. The tensile strength should be at least about 2000 pounds and preferably 3000 pounds. Furthermore, the webbing should be flexible. Heavy woven cotton is a preferred material.

The rigging or girth billet is shown in detail in FIG. 11. It is held in position by being attached to the webbing. Screws can provide for the attachment of the billet to the webbing. Preferably three screws are employed as shown in FIG. 11. FIG. 12 shows in detail a screw 122 and a nut 124 holding together the webbing 90 and the billet 110. The strap 114 of the billet 110 is located asymmetric relative to the position of the upper attachment part 112 of the billet 110. Thus by exchanging the billet from one side of the horse to the other side, the relative forward position of the strap is changed for providing adjustable positions for maximum convenience and comfort. Therefore, the offset position of the strap relative to the attachment to the webbing allows for easy changing of the rigging position. The billet is preferably constructed from 0.4 cm to 0.6 cm thick saddle skirting leather, which is preferably doubled and stitched. The stitching is preferably around the holes engaging the girth buckle for providing durability of the billet.

Figure 13:
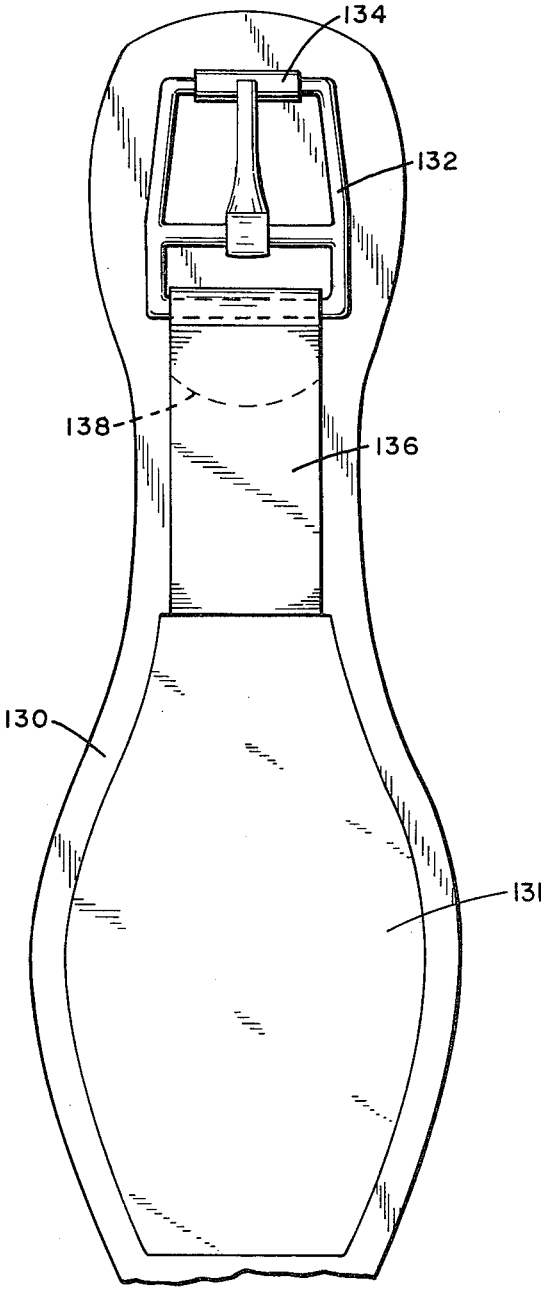
FIG. 13 is a top view of part of the girth.
Figure 14:
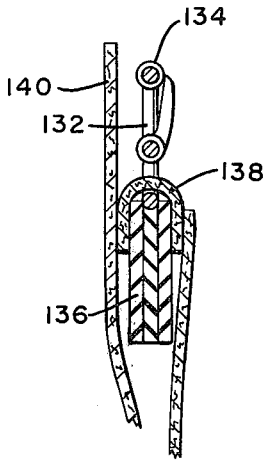
FIG. 14 is a sectional view of the girth near the buckle.

FIG. 13 shows the construction of the girth 130. Each end of the girth is provided with a buckle 132 to engage the billet. Preferably the buckle is made from stainless steel of $\frac{3}{8}$" thick stock with stainless steel rollers 134. The buckle is attached in this embodiment to a strong elastic band 136. The attachment of the buckle 132 to the elastic band is preferably provided by a leather binder 138. A preferred elastic band is a dual about 3.5 cm to 4 cm wide elastic band, which is tripled as shown in FIG. 14. The elastic band provides for a certain tension, which holds the saddle to the horse under various conditions. This tension is determined by the elastic constants of the elastic band and the band is adapted to provide for easy breathing of the horse, but at the same time for tight contact and fit of the saddle to the horse.

The area of the buckle and of the elastic bands towards the surface of the horse is covered with an overlay leather cover 140. Such overlay of leather keeps the edges nice and round. The girth is about 7 cm to 15 cm wide and preferably 9 cm to 11 cm wide in the area of the buckle and is provided with a contour for an easy fit around the legs of the horse and then widens at the heart of the girth to about 10 cm to 20 cm and preferably to about 14 cm to 16 cm width. The girth is preferably padded with felt 131 of about 0.8 cm to 1.5 cm thickness for comfort and strength.

It thus will be seen that there is provided a saddle which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

What is claimed is:

1. A horse saddle providing close contact between horse and rider comprising:

a tree having a fork located toward the front of the horse; a cantle located toward the rear of the horse; two narrow side bars of oval cross-section having a major axis of about from 4.2 cm to 5.8 cm length and a minor axis of from about 0.5 cm to 0.8 cm length through the area of the leg line and starting with such cross-section about at most 8 cm from the back side of the fork and reaching with such cross-section to at most about 4 cm away from the cantle, said bars connecting the fork with the cantle;

padding areas corresponding to the two side bars of the tree and located below the tree and having relatively narrow sections following the side bars and ending in front and rear lobes, said front lobes extending in an outward direction about vertical to the longitudinal direction of the tree bars at about the fork and said rear lobes extending in a rearward direction about parallel to the direction of the side bars at about below the cantle; and a skirt attached to the bottom of the tree, the skirt being cut out in an area bordered by part of the circumference of the skirt and by three sides with a first side located at about 1 cm to 5 cm away from the outside vertical projection of the side bars and extending about parallel to the side bars from about the middle of the fork and running to about the end of the narrow section of the side bar, a second section beginning at the end of the first side near the middle of the fork and running outwardly in a direction between about vertical to the first side and to forming an angle of about 30° with the front direction of the side bars, a third side beginning at the other end of the first side at the rear end of the side bar and running outwardly in a direction between about vertical to the first side and a direction forming an angle of about 45° with the front direction of the side bars, said three sides forming together part of the circumference of a trapezoidal to oval area.

2. The horse saddle as set forth in claim 1 wherein the section cut out from the skirt is inserted with a material thinner and more deformable than the skirt material.

3. The horse saddle as set forth in claim 2 wherein the inserted material bulges out of the cut out area of the skirt.

4. The horse saddle as set forth in claim 2 wherein the skirt is covered with soft leather.

5. The horse saddle as set forth in claim 1 further comprising:

a strong webbing on each side of the saddle from about 10 cm to 20 cm wide attached to the top and the bottom of the tree in the area of the fork and running to between about 3 cm and 15 cm downwardly from the outer side edges of the tree.

6. The horse saddle as set forth in claim 5 further comprising:

a billet on each side of the saddle having a wide section of about the width of the webbing removably attached to the webbing and changing into a narrow section diplaced from the middle of the wider section to one side for providing a dual positioning of the billet by reattaching it from one side of the saddle to the opposite side.

7. The horse saddle as set forth in claim 6 further comprising:

a girth to be attached to the billet having a width of from about 10 cm to 20 cm at the heart of the girth and from about 7 to 12 cm at the ends of the girth and fitting around the legs of the horse and comprising a roller buckle attached with elastic bands to the girth and capable of sliding longitudinally to the girth upon tensioning of the girth.

* * * * *